US006055802A

United States Patent [19]

DiVietri

[11] Patent Number: 6,055,802

[45] Date of Patent: May 2, 2000

[54] FISHHOOK JEWELRY

[76] Inventor: Peter A. DiVietri, 1837 Amboy Dr., Las Vegas, Nev. 89108

[21] Appl. No.: 09/412,628

[22] Filed: Oct. 4, 1999

[51] Int. Cl.[7] ..... F16G 15/00

[52] U.S. Cl. ..... 59/80; 59/83; 59/85

[58] Field of Search ..... 59/80, 84, 85, 59/83

[56] References Cited

U.S. PATENT DOCUMENTS

| | | | |
|---|---|---|---|
| D. 177,102 | 3/1956 | Katz . | |
| 1,414,638 | 9/1997 | Grove | 59/80 |
| 1,655,763 | 1/1928 | Fulford | 59/80 |
| 2,007,445 | 7/1935 | Goldenberg | 59/80 |
| 5,636,506 | 6/1997 | Yngvesson | 59/80 |
| 5,664,410 | 9/1997 | Nydick | 59/80 |

*Primary Examiner*—David Jones
*Attorney, Agent, or Firm*—Leonard Weiss

[57] ABSTRACT

A chain is formed from a plurality of links that resemble a fish hook. The links include a shank with one end connected to a barbed hook and an opposite end connected to an eyelet. The chain is formed by passing the hook of one link through the eyelet of another link. By selecting the size and number of the links, the chain may be produced for wear as either a necklace, a bracelet or an anklet.

7 Claims, 2 Drawing Sheets

FISHHOOK JEWELRY

BACKGROUND OF THE INVENTION

1. Field of invention

This invention is in the general field of jewelry and, more particularly, is alternatively a necklace, a bracelet or an anklet made from parts that resemble a fishhook.

2. Description of the Prior Art

Necklaces, anklets, pendants and bracelets are accessories that are comprised of an elongated member referred to as a chain. The chain is often fabricated from a precious metal, such as gold or silver.

Although sharp objects, such as a fishhook, may be unique in jewelry and aesthetically desirable for inclusion in the chain, the uniqueness and aesthetics are compromised because it is thought that a person cannot wear a sharp object, such as the fishhook, without risk of injury. Hence, objects resembling the fishhook have heretofore not been included in the chain.

Ends of the chain are connected together by a clasp to form the accessory. Clasps are well known in the jewelry trade. However, clasps are frequently difficult to use and may not have an aesthetically pleasing appearance.

Heretofore, a jeweler seldom had an option of fabricating a chain that either did not include a clasp or included a clasp that is easy to use and aesthetically pleasing. Additionally, the jeweler did not know how to obviate the risk of injury from the chain when it includes objects resembling the fishhook.

SUMMARY OF THE INVENTION

An object of the present invention is to provide jewelry that is attractive and unique.

Another object of the invention is to provide jewelry made from sharp objects that is worn by a person without risk of injury.

Another object of the invention is to provide a chain that is alternatively worn with or without a clasp.

According to the present invention, a chain is formed from a plurality of links that resemble a fish hook. The links include a shank with one end connected to a barbed hook and an opposite end connected to an eyelet. The chain is formed by passing the hook of one link through the eyelet of another link.

The invention alternatively provides a necklace, a bracelet and an anklet of simple construction that is attractive and unique.

Other objects, features, and advantages of the invention should be apparent from the following description of embodiments thereof as illustrated in the accompanying drawing.

DESCRIPTION OF THE EMBODIMENTS

Figure 1:
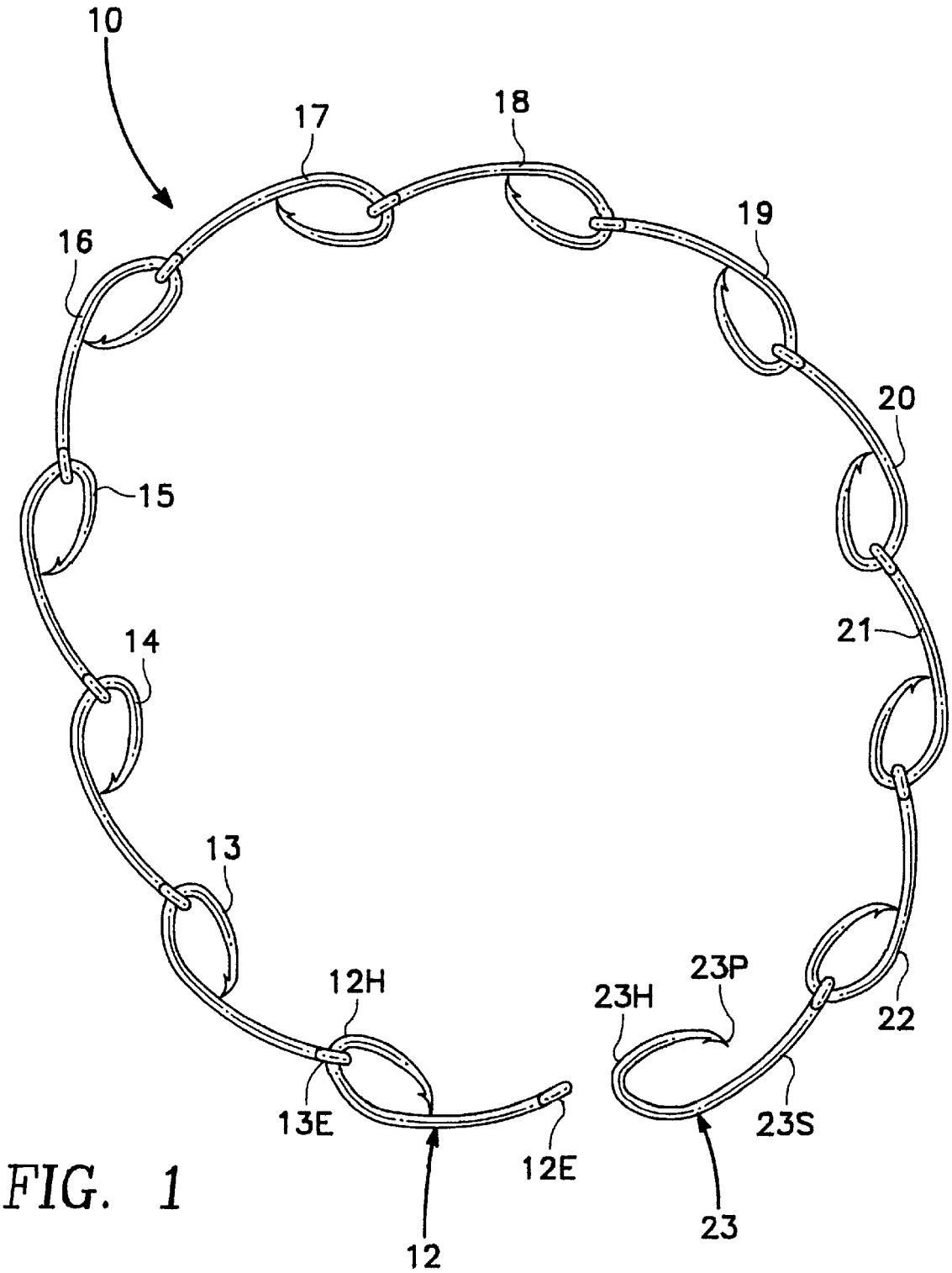
FIG. 1 is a plan view of a chain in accordance with a first embodiment of the present invention.
Figure 2:
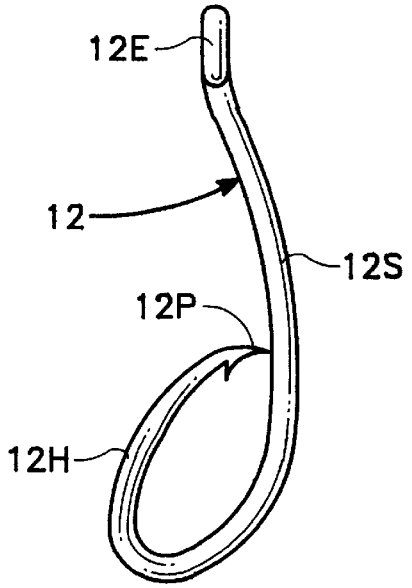
FIG. 2 is a side elevation of a link in the chain of the embodiment of FIG. 1.
Figure 3:
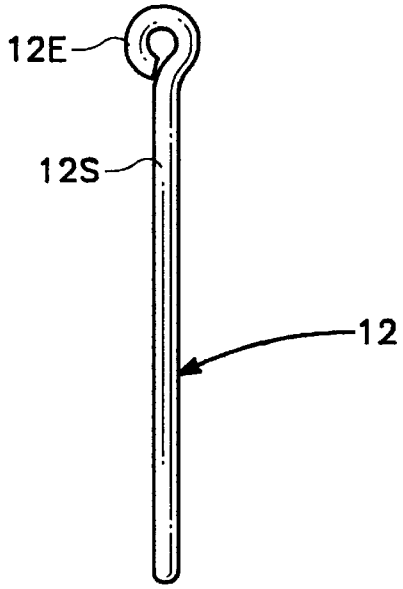
FIG. 3 is a rear elevation of the link of FIG. 2.

As shown in FIGS. 1–3, a chain 10 (FIG. 1) is made from similar interior links 12–22 and an end link 23. The end link

23 forms one end of the chain 10. The links 12–23 resemble a fishhook. The link 12 (FIGS. 2 and 3) is exemplary of the links 13–22.

The link 12 has a shank 12S with one end integrally connected to a hook 12H. An opposite end of the shank 12S is integrally connected to an eyelet 12E.

Like practically all fishhooks, the hook 12H has a barbed end 12P. The hook 12H is bent to cause the end 12P to be in a proximal relationship with the shank 12S. Preferably, the shank 12S is bowed to facilitate the proximal relationship. Because of the proximal relationship, a person wearing the chain 10 as either a necklace, a bracelet or an anklet is shielded by the shank 12S from the end 12P.

Similar to the links 12–22, the end link 23 (FIG. 1) has a shank 23S with one end integrally connected to a hook 23H that has a barbed end 23P. An opposite end of the shank 23S is integrally connected to an eyelet 23E. In this embodiment, the shank 23S is bowed to cause it to have an appearance similar to that of the shank 12S.

Unlike the links 12–22, the end 23P is spaced from the shank 23S. Because of the spacing, the hook 23H is easily passed through the eyelet 12E. Hence, the end link 23 is connectable to the link 12. It should be understood that although the end 23P is spaced from the shank 23S, the person wearing the chain 10 is shielded by the shank 23S from the end 23P.

The hook 12H passes through an eyelet 13E of the link 13 (FIG. 1) whereby the links 12, 13 are connected. In a similar manner, the links 13, 14, the links 14, 15, the links 15, 16, the links 17, 18, the links 18, 19, the links 19, 20, the links 20, 21, the links 21, 22 and the links 22, 23 are connected. When the link 23 is connected to the link 12, the chain 10 is a closed loop.

It should be understood that the size of the chain 10 is dependant upon the size of the links 12–23. Additionally, a chain, similar to the chain 10 of a selected size can be produced by making it from a selected number of links. In other words, by selecting the size and number of links of a type similar to the links 12–23, a chain may be produced for wear as either a necklace, a bracelet or an anklet.

Preferably, the links 12–23 are made from either stainless steel, platinum, gold of silver. When a molding process is used to make the links 12–22, substantial uniformity is attained.

Figure 4:
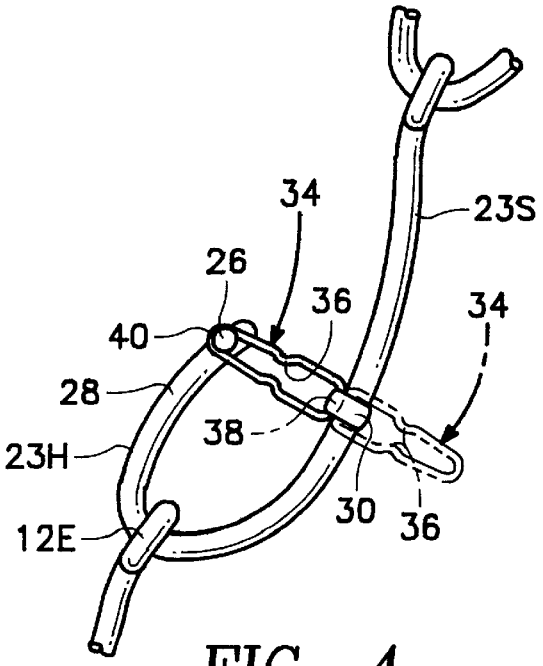
FIG. 4 is a perspective view of a portion of a second embodiment of the present invention.
Figure 5:
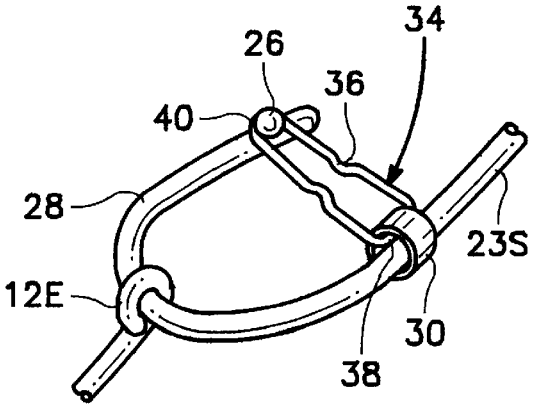
FIG. 5 is an enlarged perspective view of a portion of the embodiment of FIG. 4.

As shown in FIGS. 4 and 5, in a second embodiment of the invention, the link 23 does not include the barb 23P. A metal ball 26 is fixedly connected to the hook 23H on a side 28 thereof. Additionally, a hollow cylinder forms a sleeve 30 that has its interior connected to the shank 23S.

A spring 34 is formed by a narrow metal band in the shape of an endless loop that is constricted in a central region 36 thereof. The spring 34 has a base end 38 that passes through the interior of the sleeve 30. Opposite from the base end 38, the spring 34 has a far end 40.

It should be understood that the base end 38 is rotatable within the sleeve 30. Because the base end 38 is rotatable, the spring 34 may be positioned with the far end 40 extending in a direction away from the hook 23H (FIG. 4, shown in broken lines).

When the spring 34 is relaxed, it is extendable to the ball 26. However, the spring 34 is elastically deformable to cause the far end 40 to extend over the ball 26 and snap into a position along a junction where the ball 26 connects to the hook 23H. When the spring 34 is positioned along the junction, it maintains the hook 23H against withdrawal from the eyelet 12E. In other words, when the chain 10 forms the closed loop, the ball 26, the sleeve 30 and the spring 34 form a clasp that maintains the closed loop against opening.

I claim:

1. A chain, comprising:

a plurality of links that resemble a fishhook that has a shank with one end connected to a barbed hook and an opposite end connected to an eyelet, said links being connected by passing the hook of one link through the eyelet of another link.

2. The chain of claim 1 wherein said plurality of links includes a link at an end of said chain connected to an interior link having a hook that is bent to cause a barbed end thereof to be in a proximal relationship with a shank of said interior link, a barbed end of a hook of said end link being spaced from a shank of said end link.

3. The chain of claim 2 wherein said interior link has a shank that is bowed to facilitate said proximal relationship.

4. The chain of claim 2 wherein said end link has a shank that is bowed.

5. The chain of claim 2 wherein the hook of said end link passes through an eyelet of an interior link to form a closed loop, additionally comprising a clasp that is operable to maintain said closed loop against opening.

6. The chain of claim 5 wherein said clasp comprises;

a metal ball fixedly connected to the hook of said end link;

a hollow cylindrical sleeve wherein the shank of said end link is connected;

a spring formed by a metal band in the shape of an endless loop that has a base end and a far end, said base end passing through the interior of said sleeve, said spring being elastically deformable to cause said far end to extend over said ball and snap into a position along a junction where said ball connects to said hook of said end link.

7. The chain of claim 6 wherein said endless loop is constricted near a central portion thereof and said base end being rotatable within said sleeve.

* * * * *